United States Patent [19]

Mars

[11] Patent Number: 5,060,386

[45] Date of Patent: Oct. 29, 1991

[54] CURVED HANDLE EATING UTENSIL FOR THE PHYSICALLY DISABLED

[76] Inventor: Suzanne P. Mars, 23649 Duffield Rd., Shaker Heights, Ohio 44122

[21] Appl. No.: 509,559

[22] Filed: Apr. 16, 1990

[51] Int. Cl.[5] ..... A47J 43/28; A47J 45/00; A47J 43/00

[52] U.S. Cl. ..... 30/327; 30/324; 30/150

[58] Field of Search ..... 30/109, 198, 263, 273, 30/290, 323, 324, 327, 150

[56] References Cited

U.S. PATENT DOCUMENTS

| | | | |
|---|---|---|---|
| D. 43,208 | 10/1912 | Stuver | 30/327 |
| D. 58,881 | 9/1921 | Canellas | 30/150 |
| 438,379 | 10/1890 | Levinger | 30/324 |
| 784,830 | 3/1905 | Beistle | 30/327 |
| 1,128,190 | 2/1915 | Routery | 30/327 |
| 1,347,307 | 7/1920 | Thomas | 30/324 |
| 2,724,894 | 11/1955 | La Tour | 30/324 |
| 2,942,347 | 6/1960 | Warren et al. | 30/327 |
| 2,995,265 | 8/1961 | Soerberg | 30/327 |
| 4,779,344 | 10/1988 | Panisch | 30/324 |

FOREIGN PATENT DOCUMENTS

| | | | |
|---|---|---|---|
| 4087 | of 1895 | United Kingdom | 30/327 |

*Primary Examiner*—Douglas D. Watts
*Assistant Examiner*—Sr. Heyrana
*Attorney, Agent, or Firm*—Weston Hurd Fallon Paisley & Howley

[57] ABSTRACT

The present invention is an eating utensil for the physically disabled. The invention comprises a base, a handle, projecting from the base, a shaft and utensil head. The handle is irregularly shaped, comprising a curved front surface, a first side surface, a second side surface, and a curved back surface; and a flat back surface which extends from the curved back surface. The base has flat bottom surface of the base enables the eating utensil to remain upright on the table so that the eating utensil may be easily grasped and picked up. In addition, the utensil head may be modified to increase the surface area available for the food and to increase stability of the food on the eating utensil. The new and improved eating utensil is capable of being used with individuals with a variety of disabilities, particularly those individuals with limited wrist movement.

12 Claims, 3 Drawing Sheets

CURVED HANDLE EATING UTENSIL FOR THE PHYSICALLY DISABLED

BACKGROUND OF THE INVENTION

1. Field of the Invention

The invention relates to eating utensils which enable people with hand and wrist disabilities, particularly limited range of motion in the wrist, to feed themselves.

2. Description of the Prior Art

Physical disabilities of the hands and wrists make it particularly difficult for people to carry out simple functions of everyday life. In particular, feeding oneself with ordinary eating utensils presents a burdensome task to such individuals, particularly individuals whose wrist movement is limited due to conditions such as arthritis. For conventional eating utensils the nondisabled individual must possess a certain degree of fine motor skills in order to pick up and hold the utensils. In addition, a non-disabled individual using conventional eating utensils must use a variety of different manipulations involving multiple muscles of the hands and arms, and involving multiple joints in the fingers, hands, wrists and elbows. Manipulations require a high degree of coordinated movement in order to successfully feed oneself without dropping or spilling the food. However, for people possessing disabilities, more particularly joint disabilities such as limited wrist movement, picking up and using the eating utensils painful and require a tremendous amount of time to execute a simple motion. By "conventional eating utensils" herein, we are referring to forks, knives and spoons, known in the prior art which are generally laid out along a single axis and possess thin, small handles of about one-half inch to one inch, wide.

While modifications have been made to enlarge the handles of conventional eating utensils to provide an easier grip, this does not eliminate the wrist rotation required to feed oneself with these utensils.

Desirably, eating utensils would be available that would avoid the drawbacks of conventional eating utensils and be capable of use without wrist movement.

SUMMARY OF THE INVENTION

The present invention overcomes the foregoing drawbacks of the prior art and provides a new and improved eating utensil comprising a base, a handle, a shaft and an eating utensil head. The base is connected to the handle and to the shaft. The shaft is also connected to the eating utensil head. The handle is new and improved; it provides a comfortable means for grasping the utensil and using the utensil with little or no wrist movement.

DESCRIPTION OF THE PREFERRED EMBODIMENT

Figure 1:
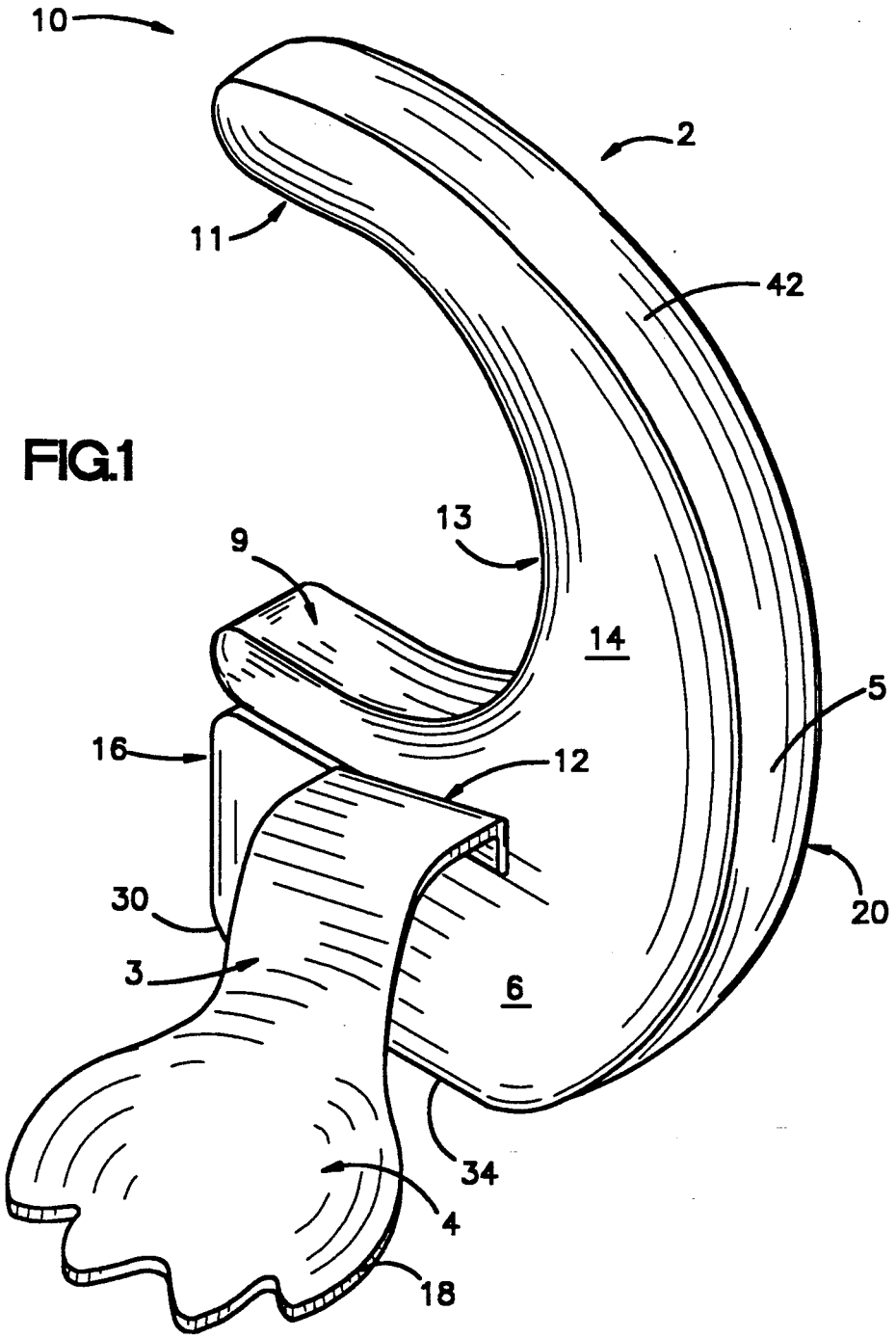
FIG. 1 is a left side perspective view.

Referring to FIGS. 1, 2, 3 and 4, the eating utensil 10 comprises a base 16, a handle 2, a shaft 3 and an eating utensil head 4.

THE BASE

The base 16 of the eating utensil 10 serves to support the eating utensil 10. The base 16 has a flat bottom surface 17, adapted for resting on a flat horizontal surface such as a table. This flat bottom surface 17 permits the eating utensil 10 to remain upright when not in use. As a result, the eating utensil 10 may be easily grasped when a person wishes to use it.

The base 16 is defined by a flat bottom surface 17, a first side surface 6, which is also the left side when facing the utensil 10, such first side surface 6 extends perpendicularly from the bottom surface 17; a second side surface 7, parallel to the first side surface 6, which second side surface 7 extends perpendicularly from the bottom surface 17; a front surface 5, preferably curved which extends perpendicularly from the bottom surface 17, such front surface 5 being perpendicular to the first side surface 6 and to the second side surface 7; a back surface 8, which extends perpendicularly from the bottom surface 17, such back surface 8 being perpendicular to the first side surface 6 and to the second side surface 7; and top surface 9, which is parallel to the bottom surface 17, said top surface 9 being perpendicular to the first side surface 6, the second side surface 7, and the back surface 8. The back edge 30 of the bottom surface 17 is contiguous with the bottom edge 32 of the back surface 8. The left side edge 34 of the bottom surface 17 is contiguous with the bottom edge 36 of the first side surface 6. The right edge 38 of the bottom surface 17 is contiguous with the bottom edge 40 of the second side surface 7. The plane of the bottom surface 17 is perpendicular to the first side surface 6, the second side surface 7, and the back surface 8. Projecting upward from the base is the handle 2.

THE HANDLE

The handle 2 is irregularly shaped, comprising: a curved front surface 42, which is continuous with the front surface 5 of the base; a first side surface 14, continuous with the first side surface 6 of the base; a second side surface 15, continuous with the second side surface 7 of the base; a curved back surface 13 which extends from the top flat surface 9 of the base; and a flat back surface 11 which extends from the curved back surface 13.

Figure 2:
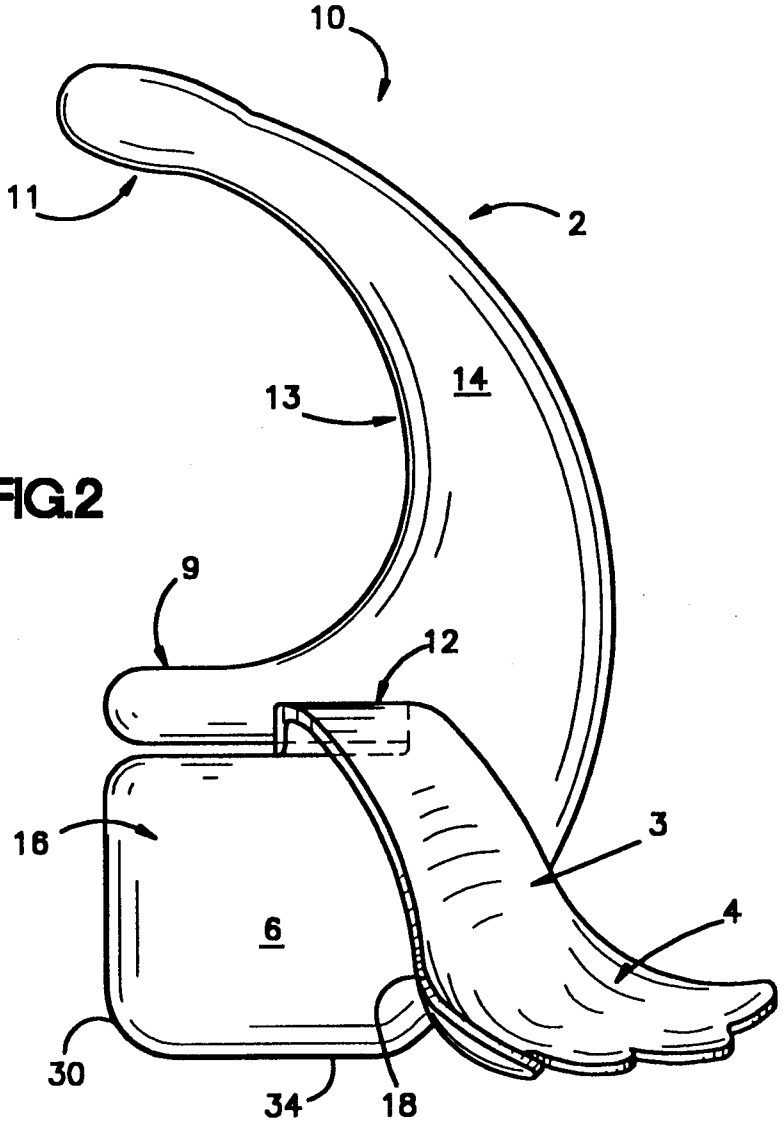
FIG. 2 is the device of FIG. 1, left side view.

The curvature of the curved back surface 13 is defined as an arc of a circle the radius of such circle being from about 1 inch to about 3 inches, preferably about two inches. The curved back surface 13 extends into a flat back surface 11 as shown in FIG. 2. The flat back surface 11 extends from about ½ inch to about 3 inches, preferably about 1 inch beyond the curved back surface 13.

Although the eating utensil 10 may be grasped in any manner that is comfortable to the user, it is contemplated that the utensil 10 may be held by resting the second side surface 15 of the handle 2 in the right palm of the hand with all four fingers bent around the handle 2 wrapping around curved back surface 13 so that the ends of the fingers come to rest on first side surface 14 of the handle 2 with the tips of the fingers pointing toward the user. The ventral side of the thumb for substantially the entire length of the thumb, rests comfortably along the curved front surface 42 of the handle 2. The utensil 10 may be used to gather food and to bring the utensil 10 to the user's mouth without moving the wrist. The eating utensil 10 is lifted by lifting the entire arm, primarily using upper arm muscles. The utensil head 4 is brought toward the mouth by rotating the elbow joint.

THE SHAFT

Figure 4:
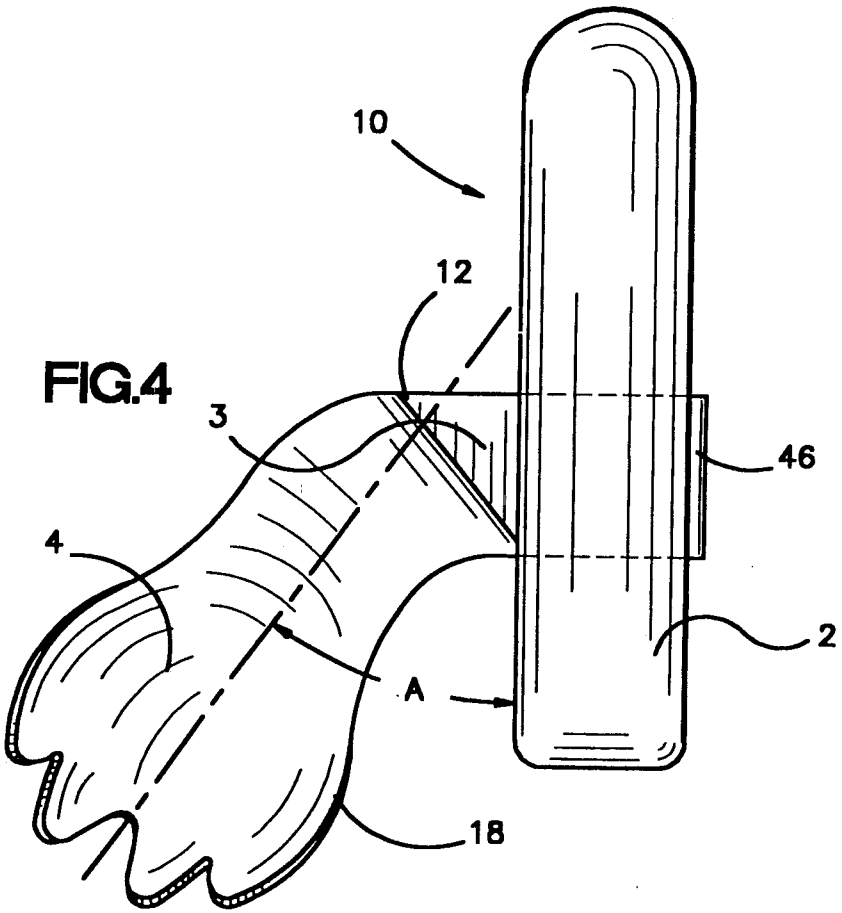
FIG. 4 is the device of FIG. 1, top plan view.

The shaft 3 projects from the first side surface 6 of the base 16 at an angle A (as shown in FIG. 4) from about thirty-five degrees to about sixty degrees, preferably forty-five degrees. This angle may be achieved by fixing the shaft 3 at the desired angle from the first side surface 6 of the base 16. Preferably the angle is achieved by affixing the shaft 3 so that it projects ninety degrees from the first side surface 6 of the base 16; the direction of the shaft 3 is then changed to preferably forty-five degrees by a fold 12 of the shaft 3. The shaft 3 is attached on the first side surface 6 of the base 16 at approximately one and a half inches from the bottom edge 36 of first side surface 6 of the base 16. The shaft 3 curves downward preferably from a point beyond the fold 12 in the shaft 3, to approximately table level. The shaft 3 terminates in the eating utensil head 4. The bottom surface 21 of the eating utensil head 4 rests on the same flat surface, such as an eating table, as does bottom surface 17. The bottom surface 44 of the eating utensil head 14 lies in approximately the same plane as surface 17.

By providing two points of contact the eating utensil 10 is stable in an upright position. When upright, the eating utensil 10 may be easily grasped by virtually a single movement.

THE EATING UTENSIL HEAD

As used herein, the eating utensil head 4 is that part of the eating utensil 10 which is adapted to collect and hold the food and which comes in contact with the mouth.

The eating utensil head 4 may be a forkhead 46 or a spoon 48 or combination of a forkhead and spoonhead, known as a "spork" 19. The eating utensil head 4 may be equipped with one or more tines 50 which enable the eating utensil 10 to have the spearing action of a conventional fork. However, the area behind the tines 50 between the back of the tines 50 and the shaft 3 is enlarged to provide a greater surface area for holding food. In addition, this area between the back of the tines 50 and the shaft 3 may be depressed to give a bowl effect which aids in the stability in keeping the food on the fork. In addition the back sides 18 of the head of the spork 19 may be raised, which helps to keep food from falling off.

While one embodiment of the invention has been shown and described, various adaptations and modifications could be made without departing from the scope of the invention as defined in the appended claims. Particularly the dimensions may be enlarged to accommodate a larger hand, or reduced to accommodate the size of the child's hand.

What is claimed is:

1. An eating utensil for used by persons with limited wrist movement, comprising:

a base for resting upon a flat horizontal surface, the base being in the shape of a geometric solid, the base including a front surface, a back surface, a top surface, a bottom surface, and opposed side surfaces;

a curved handle for grasping the utensil, said handle extending upwardly from the base from a location adjacent the intersection of the front surface and the top surface, the handle extending generally vertically and rearwardly so as to overlie the top surface, the handle and the top surface being spaced a distance adequate to permit the fingers of a user's hand to be fitted therebetween;

a utensil head, the utensil head projecting laterally from the base at a vertical location in the region of the bottom surface, the utensil head lying in a generally horizontal plane when the base is resting on the horizontal surface; and a shaft having a first end and a second end, the first end being connected to the base and the second end being connected to the utensil head.

2. The eating utensil of claim 1, wherein the base is defined by a flat bottom surface lying in a horizontal plane, a first side surface, which first side surface extends generally vertically from the bottom surface;

a second side surface, parallel to the first side surface, which second side surface extends generally vertically from the bottom surface;

a curved front surface which extends generally vertically from the bottom surface, such front surface being perpendicular to the first side surface and to the second side surface; and a back surface which extends generally vertically from the bottom surface, such back surface being perpendicular to the first side surface and to the second side surface.

3. The eating utensil of claim 1, wherein the handle is irregularly shaped, comprising:

a curved front surface, said front surface being continuous with the front surface of the base;

a first side surface, said first side surface being continuous with the first side surface of the base;

a second side surface, said second side surface being continuous with the second side surface of the base; and a curved back surface which extends in a loop from the back surface of the base to meet the curved front surface.

4. The eating utensil of claim 1, wherein the shaft is positioned at an angle of from about 35° to about 65°, relative to the base.

5. The eating utensil of claim 1, wherein the shaft is positioned at an angle of about 45°, relative to the base.

6. The eating utensil of claim 1, wherein the curved back surface of the handle has a radius of curvature from about 1 inch to about 3 inches.

7. The eating utensil of claim 1, wherein the curved back surface of the handle has a radius of curvature of about 2 inches.

8. The eating utensil of claim 1, wherein the shaft curves downward from the point of attachment to the handle to the utensil head.

9. The eating utensil of claim 1, wherein the utensil head is the head of a spoon.

10. The eating utensil of claim 1, wherein the utensil head is the head of a fork.

11. The eating utensil of claim 1, wherein the utensil head is the head of a spork.

12. The eating utensil of claim 1, wherein the utensil head includes a flat bottom surface.

* * * * *

UNITED STATES PATENT AND TRADEMARK OFFICE

CERTIFICATE OF CORRECTION

PATENT NO. : 5,060,386

DATED : Oct. 29, 1991

INVENTOR(S) : Suzanne P. Mars

Figure 3:
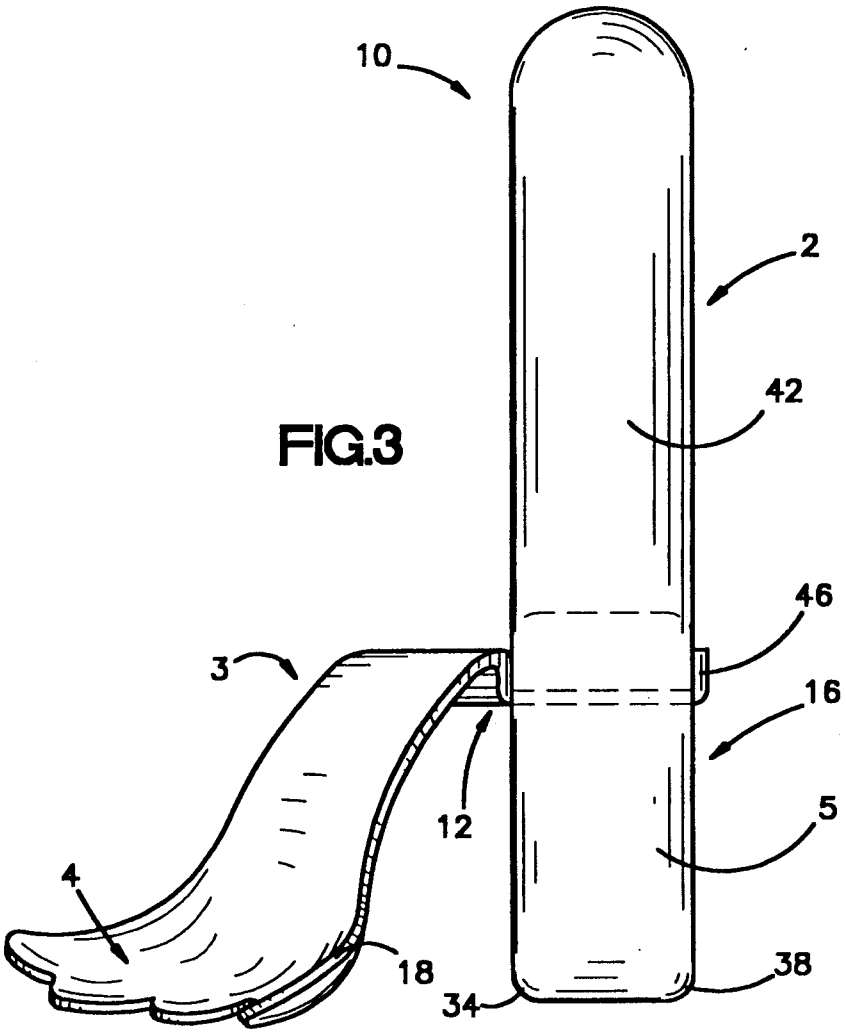
FIG. 3 is the device of FIG. 1, front view.

It is certified that error appears in the above-indentified patent and that said Letters Patent is hereby corrected as shown below:

Column 1 under DESCRIPTION OF THE DRAWINGS lines 58-62 please delete and insert:

Figure 1 is a perspective view of an eating utensil according to the invention;

Figure 2 is a side elevational view of the eating utensil of Figure 1, viewed from the left in Figure 1;

Figure 3 is a front elevational view of the eating utensil of Figure 1;

Figure 4 is a top plan view of the eating utensil of Figure 1; and

Figure 5:
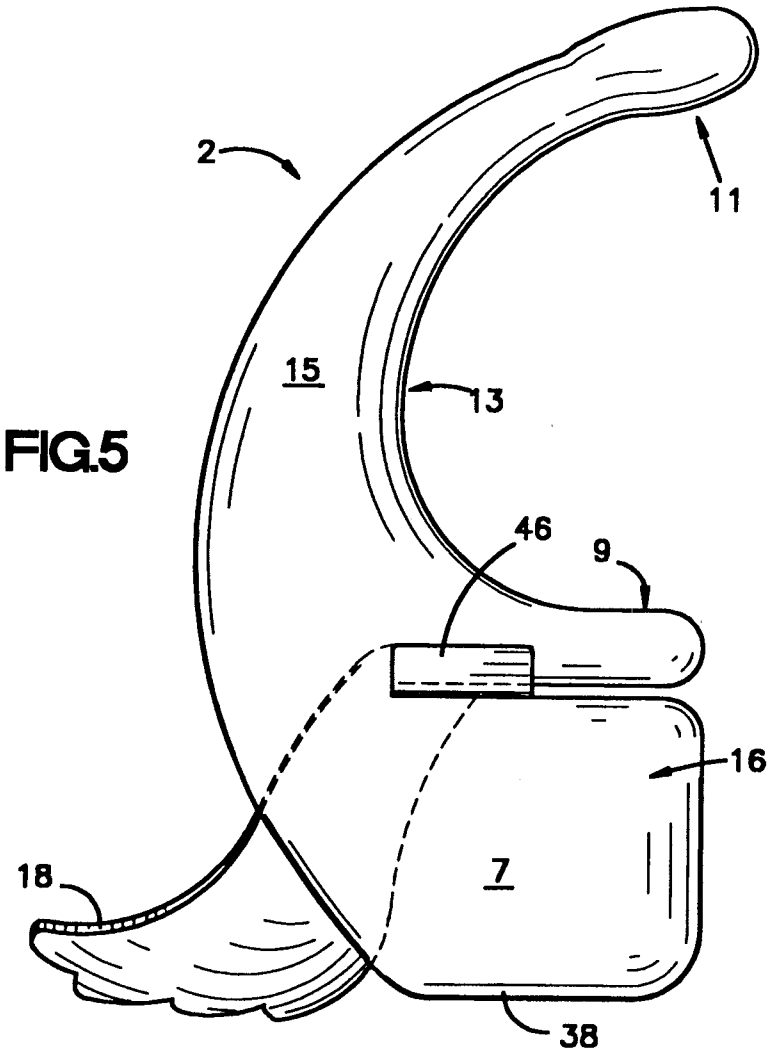
FIG. 5 is the device of FIG. 1 right side view.

Figure 5 is a side elevational view similar to Figure 2, but of the opposite side of the eating utensil of Figure 1. --

UNITED STATES PATENT AND TRADEMARK OFFICE

CERTIFICATE OF CORRECTION

PATENT NO. : 5,060,386

DATED : Oct. 29, 1991

INVENTOR(S) : Suzanne P. Mars

It is certified that error appears in the above-indentified patent and that said Letters Patent is hereby corrected as shown below:

Column 3, line 21: after "The" insert -- eating utensil head 4 has a --;

Column 3, line 22; delete "21" and insert -- 44 --;

Column 3, line 22; delete "of the";

Column 3, line 22; delete "eating utensil head 4" and insert -- which --;

UNITED STATES PATENT AND TRADEMARK OFFICE

CERTIFICATE OF CORRECTION

PATENT NO. : 5,060,386

DATED : Oct. 29, 1991

INVENTOR(S) : Suzanne P. Mars

It is certified that error appears in the above-indentified patent and that said Letters Patent is hereby corrected as shown below:

Column 3, between lines 27 and 28 insert the following paragraph:

-- The first end of the shaft 3 forms a lip 46 which fits snugly against second side surface 15 of the handle 2. The lip 46 prevents the shaft 3 from becoming disengaged from the handle 2 as a result of lateral movement of the eating utensil head 4. The shaft 3 is attached to, or detached from, the handle 2 by way of a slot 48 formed between the handle 2 and the base 16. The slot 48 is sized such that an interference fit with the shaft 3 is achieved, which interference fit tends to keep the shaft 3 in place, while permitting the removal of the eating utensil head 4 for purposes of cleaning, storage, or shipping.

UNITED STATES PATENT AND TRADEMARK OFFICE

CERTIFICATE OF CORRECTION

PATENT NO. : 5,060,386

DATED : Oct. 29, 1991

INVENTOR(S) : Suzanne P. Mars

It is certified that error appears in the above-indentified patent and that said Letters Patent is hereby corrected as shown below:

Column 3;

line 38, delete "46";

line 39, delete "48";

line 40, delete "19";

line 41, delete "50";

line 43-44 delete "50" and "50";

line 46, delete "50";

line 48 delete "back" and "18";

line 49 delete "19".

Signed and Sealed this

Twenty-second Day of June, 1993

*Attest:*

Michael K. Kirk

MICHAEL K. KIRK

*Attesting Officer*

*Acting Commissioner of Patents and Trademarks*